US008042804B2

(12) United States Patent
Suzuki

(10) Patent No.: US 8,042,804 B2
(45) Date of Patent: Oct. 25, 2011

(54) SHEET CONVEYING APPARATUS AND IMAGE FORMING APPARATUS

(75) Inventor: Tetsuji Suzuki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 71 days.

(21) Appl. No.: 12/410,977

(22) Filed: Mar. 25, 2009

(65) Prior Publication Data

US 2009/0243212 A1 Oct. 1, 2009

(30) Foreign Application Priority Data

Mar. 31, 2008 (JP) ..... 2008-092675

(51) Int. Cl.
*B65H 29/70* (2006.01)

(52) U.S. Cl. ..... 271/188; 492/33

(58) Field of Classification Search ..... 271/188, 271/119; 492/30, 33, 36, 28, 27
See application file for complete search history.

(56) References Cited

U.S. PATENT DOCUMENTS

| | | | | |
|---|---|---|---|---|
| 2,660,429 | A * | 11/1953 | Lorig | 226/192 |
| 5,163,674 | A * | 11/1992 | Parks | 271/274 |
| 5,348,283 | A | 9/1994 | Yanagi et al. | 271/127 |
| 5,370,380 | A | 12/1994 | Suzuki et al. | 271/21 |
| 5,580,042 | A | 12/1996 | Taniguro et al. | 271/274 |
| 5,620,174 | A | 4/1997 | Taniguro et al. | 271/10.12 |
| 5,648,808 | A | 7/1997 | Yanagi et al. | 347/104 |
| 5,672,019 | A | 9/1997 | Hiramatsu et al. | 400/624 |
| 6,190,070 | B1 * | 2/2001 | Urban et al. | 400/636.3 |
| 6,792,241 | B2 | 9/2004 | Nakagawa et al. | 399/367 |
| 2004/0192528 | A1 | 9/2004 | Fukase et al. | 492/53 |

FOREIGN PATENT DOCUMENTS

| | | |
|---|---|---|
| JP | 2004-301291 | 10/2004 |
| JP | 2006-145586 | 6/2006 |

* cited by examiner

*Primary Examiner* — Michael McCullough
(74) *Attorney, Agent, or Firm* — Fitzpatrick, Cella, Harper & Scinto

(57) ABSTRACT

A sheet conveying apparatus for conveying a sheet having an image formed thereon includes: a first rotator; a second rotator that comes into pressure contact with the first rotator and contacts a surface of the sheet having the image formed thereon; and a plurality of ribs that are formed on a circumferential surface of the second rotator and disposed in an axial direction so as to be continuous in a circumferential direction. Among the plurality of ribs, the ribs disposed at both ends of the second rotator in the axial direction have a diameter that is smaller than those of the other ribs.

12 Claims, 10 Drawing Sheets

*FIG. 7*

| | CONTACT WIDTH S OF EACH MINUTE RIB WITH SHEET [μm] | | | | |
|---|---|---|---|---|---|
| | 100 | 400 | 600 | 1000 | |
| EVALUATION OF IMAGE QUALITY | ○ | ○ | ○ | × | |
| | PITCH P BETWEEN MINUTE RIBS [μm] | | | | |
| | 200 | 300 | 700 | 1000 | 1500 |
| EVALUATION OF IMAGE QUALITY | ○ | ○ | ○ | ○ | × |
| | HEIGHT H OF MINUTE RIB [μm] | | | | |
| | 35 | 100 | 300 | | |
| EVALUATION OF IMAGE QUALITY | × | ○ | ○ | | |
| | HEIGHT DIFFERENCES ΔH1 TO ΔH4 BETWEEN ADJACENT MINUTE RIBS [μm] | | | | |
| | 0 | 20 | 60 | 100 | |
| EVALUATION OF IMAGE QUALITY | ○ | ○ | ○ | × | |
| | HEIGHT DIFFERENCE D BETWEEN MINUTE RIB DISPOSED AT CENTER AND MINUTE RIBS DISPOSED AT BOTH ENDS [μm] | | | | |
| | 0 | 20 | 110 | 210 | 500 |
| EVALUATION OF IMAGE QUALITY | × | ○ | ○ | ○ | × |

*FIG. 8*

P=200μm, S=0-600μm, H=100-300μm

| ΔH ＼ D | 0 | 20 | 110 | 210 | 500 |
|---|---|---|---|---|---|
| 0 | X | O | X | X | X |
| 20 | X | O | O | X | X |
| 60 | X | O | O | X | X |
| 100 | X | X | X | X | X |

P=700μm, S=0-600μm, H=100-300μm

| ΔH ＼ D | 0 | 20 | 110 | 210 | 500 |
|---|---|---|---|---|---|
| 0 | X | O | X | X | X |
| 20 | X | O | <O> | X | X |
| 60 | X | O | O | O | X |
| 100 | X | X | X | X | X |

P=1000μm, S=0-600μm, H=100-300μm

| ΔH ＼ D | 0 | 20 | 110 | 210 | 500 |
|---|---|---|---|---|---|
| 0 | X | X | X | X | X |
| 20 | X | X | O | X | X |
| 60 | X | X | O | O | X |
| 100 | X | X | X | X | X |

SHEET CONVEYING APPARATUS AND IMAGE FORMING APPARATUS

BACKGROUND OF THE INVENTION

1. Field of the Invention

The present invention relates to a sheet conveying apparatus and an image forming apparatus.

2. Description of Related Art

In image forming apparatuses according to the related art, such as a copying machine, a printer, and a facsimile, a toner image formed on a photosensitive drum, which is an image bearing member, provided in an image forming portion is transferred onto a sheet, and the sheet is conveyed to a fixing device. Then, the fixing device heats and presses the sheet to fix the toner image to the sheet, and a sheet conveying apparatus discharges the sheet having the toner image fixed thereto to a sheet discharging and stacking portion.

However, in the image forming apparatus according to the related art, for example, when a roller comes into contact with a surface of the sheet having the toner image formed thereon or the rear surface thereof before the toner image that is heated and fixed at a high temperature is cooled down, the surface property of the contact portion is changed or the contact portion dissipates heat from the sheet earlier than the other portions. Consequently, the color of the toner image is changed, or a so-called roller trace, which is viewed as a brilliance difference, occurs, which results in deterioration of image quality. The roller trace is less likely to be visually viewed from a plain sheet, but is more likely to be viewed from a sheet having a high degree of brilliance, such as a projector sheet, glossy paper, or a glossy film.

In order to prevent deterioration of image quality due to the generation of the roller trace, for example, a structure has been proposed in which a roller having an insulating property is used as a conveying roller (discharge roller) of a sheet conveying apparatus contacted with a toner image that is heated and fixed at a high temperature (see Japanese Patent Laid-Open No. 2004-301291).

FIG. 10A is a diagram illustrating the structure of the roller having an insulating property. The roller includes an insulator layer 101 that is formed on a circumferential surface of a metal shaft 100, an uneven portion 102 that is formed on the insulator layer 101, and a surface protecting layer 103 that is formed on a circumferential surface of the insulator layer 101.

Furthermore, in order to prevent deterioration of image quality due to the generation of the roller trace, for example, a structure has been proposed in which a roller having a small contact area with a sheet is used as a roller of a sheet conveying apparatus contacted with a toner image that is heated and fixed at a high temperature (see Japanese Patent Laid-Open No. 2006-145586).

FIG. 10B is a diagram illustrating the structure of the roller. The roller 110 includes a plurality of minute protrusions 110*a* on an outer circumferential surface thereof that contacts a toner image heated and fixed to a sheet. The minute protrusions 110*a* enable the roller to come into point contact with the toner image on the sheet before the toner image is cooled down, thereby preventing the generation of a roller trace.

However, in the sheet conveying apparatus according to the related art that uses the roller having an insulating property, the manufacturing cost of the roller (insulating roller) is increased since a material forming the insulator layer is expensive. In addition, the hardness of an insulator forming the insulator layer is low. Therefore, when a skid comes into pressure contact with the roller, the insulator layer is compressed, and an insulating effect is lowered. As a result, a roller trace occurs, and image quality deteriorates. In order to prevent the insulating effect from being lowered, when the urging force of a spring that presses, for example, a skid against the roller, the conveying force (discharge force) of a pair of rollers is lowered. As a result, it is difficult to reliably discharge sheets.

In addition, in the sheet conveying apparatus according to the related art that has a plurality of minute protrusions on the outer circumferential surface thereof, in some cases, a toner parting property deteriorates by the plurality of minute protrusions formed on the outer circumferential surface of the roller. When the toner parting property deteriorates as described above, the following problem arises. When the sheet having the toner image heated and fixed thereto passes through a pair of rollers before the toner image is cooled down, toner on the sheet is peeled off, which results in deterioration of image quality. The peeled toner is likely to adhere to the rollers.

When a contact area between toner and the rollers is small and the heights of contact portions between the minute protrusions and the sheet are not uniform, the minute protrusions formed on the outer circumferential surface of the roller cause high pressure to be locally applied to the sheet. Consequently, toner on the sheet is peeled off, or the sheet is deformed and an uneven portion is formed on the sheet. As a result, image quality deteriorates.

In order to prevent the peeled toner from adhering to the roller, it is considered to form a surface protecting layer on the circumferential surface of the roller. However, when the surface protecting layer is formed, the protrusions on the outer circumferential surface of the roller are gently inclined. As a result, a contact area between toner on the sheet and the roller is increased, and it is difficult to sufficiently prevent the generation of a roller trace.

SUMMARY OF THE INVENTION

The present invention provides a sheet conveying apparatus capable of reliably conveying a sheet with a low cost, without deteriorating image quality and an image forming apparatus including the same.

According to an aspect of the invention, there is provided a sheet conveying apparatus for conveying a sheet having an image formed thereon. The sheet conveying apparatus includes: a first rotator; a second rotator that comes into pressure contact with the first rotator and contacts a surface of the sheet having the image formed thereon; and a plurality of ribs that are formed on a circumferential surface of the second rotator and disposed in an axial direction so as to be continuous in a circumferential direction. Among the plurality of ribs, the ribs disposed at both ends of the second rotator in the axial direction have a diameter that is smaller than those of the other ribs.

According to another aspect of the invention, there is provided a sheet conveying apparatus for conveying a sheet having an image formed thereon. The sheet conveying apparatus includes: a first rotator; a second rotator that comes into pressure contact with the first rotator and contacts a surface of the sheet having the image formed thereon; and a plurality of ribs that are formed on a circumferential surface of the second rotator and disposed in an axial direction so as to be continuous in a circumferential direction. Among the plurality of ribs, adjacent ribs have the same diameter, or one of the adjacent ribs close to the center in the axial direction has a diameter that is larger than that of the other rib close to both ends in the axial direction. A height difference between adjacent ribs is 0 μm or more and 60 μm or less, and a height difference between the rib disposed at the center of the second rotator and the ribs disposed at both ends thereof in the axial direction is 20 μm or more and 210 μm or less.

According to the above aspects of the invention, it is possible to reliably convey a sheet with a low cost, without deteriorating image quality.

Further features of the present invention will become apparent from the following description of exemplary embodiments (with reference to the attached drawings).

BRIEF DESCRIPTION OF THE DRAWINGS

FIG. 7 is a diagram illustrating the evaluation of a toner image when parameters of the minute ribs are changed;

FIG. 8 is a diagram illustrating the correlation between the parameters of the minute ribs;

DESCRIPTION OF THE EMBODIMENTS

Hereinafter, exemplary embodiments of the invention will be described in detail with reference to the accompanying drawings.

Figure 1:
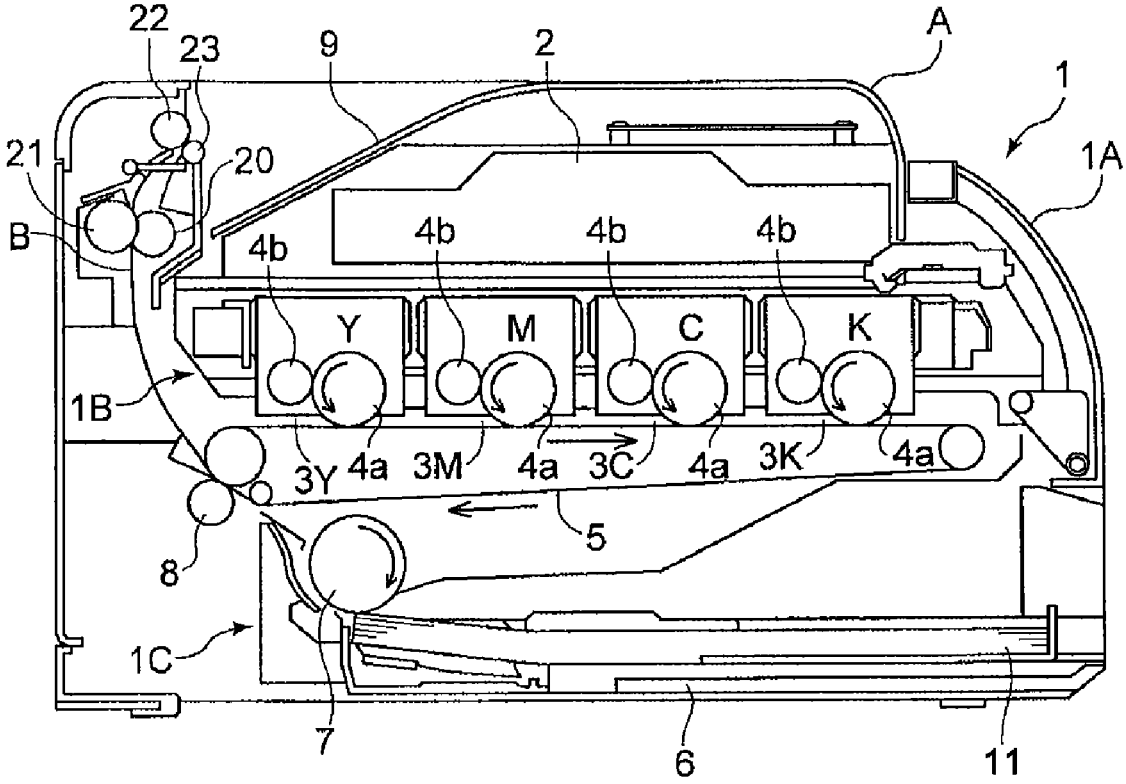
FIG. 1 is a diagram illustrating the structure of a laser beam printer, which is an example of an image forming apparatus according to a first embodiment of the invention.

FIG. 1 is a diagram illustrating the structure of a laser beam printer, which is an example of an image forming apparatus according to a first embodiment of the invention. In FIG. 1, a laser beam printer 1 includes a laser beam printer body 1A (hereinafter, referred to as a printer body).

A laser scanner 2 is provided above the printer body 1A, and an image forming portion 1B is provided below the laser scanner 2. In this embodiment, the image forming portion 1B forms an image using electrophotographic system, and includes four image forming units 3 (3Y, 3M, 3C, and 3K) that form yellow (Y), magenta (M), cyan (C), and black (K) toner images, respectively.

The image forming units 3 have the same structure except for toner colors. In each of the image forming units, a charging unit (not illustrated) uniformly charges a photosensitive drum 4*a* and the laser scanner 2 radiates light corresponding to an image signal to the photosensitive drum, thereby forming an electrostatic latent image. Then, a development device 4*b* develops the electrostatic latent image into a toner image, thereby obtaining a visible image.

An endless intermediate transfer belt 5 rotatably contacts each of the photosensitive drums 4*a*, and the toner images that are formed on the photosensitive drums 4*a* by the above-mentioned method are transferred onto the intermediate transfer belt 5 so as to overlap each other, thereby forming a color image.

In addition, a sheet feed portion 1C including a feed roller 7 that feeds sheets loaded in a sheet cassette 6 is provided below the printer body 1A. In the sheet feed portion 1C, a sheet in the sheet cassette 6 is fed to a secondary transfer portion, which is a nip portion provided between a secondary transfer roller 8 and the intermediate transfer belt 5, by the feed roller 7 in synchronization with the formation of the toner image.

The toner image on the intermediate transfer belt 5 is transferred to the sheet fed to the secondary transfer portion by the secondary transfer portion. In addition, the sheet having the toner image transferred thereon is conveyed to a fixing device B that is provided above the secondary transfer portion. The fixing device B heats and fixes the sheet to fix the transferred toner image to the sheet. Then, the sheet having the toner image thermally fixed thereto is discharged to a discharge tray 9.

Figure 2:
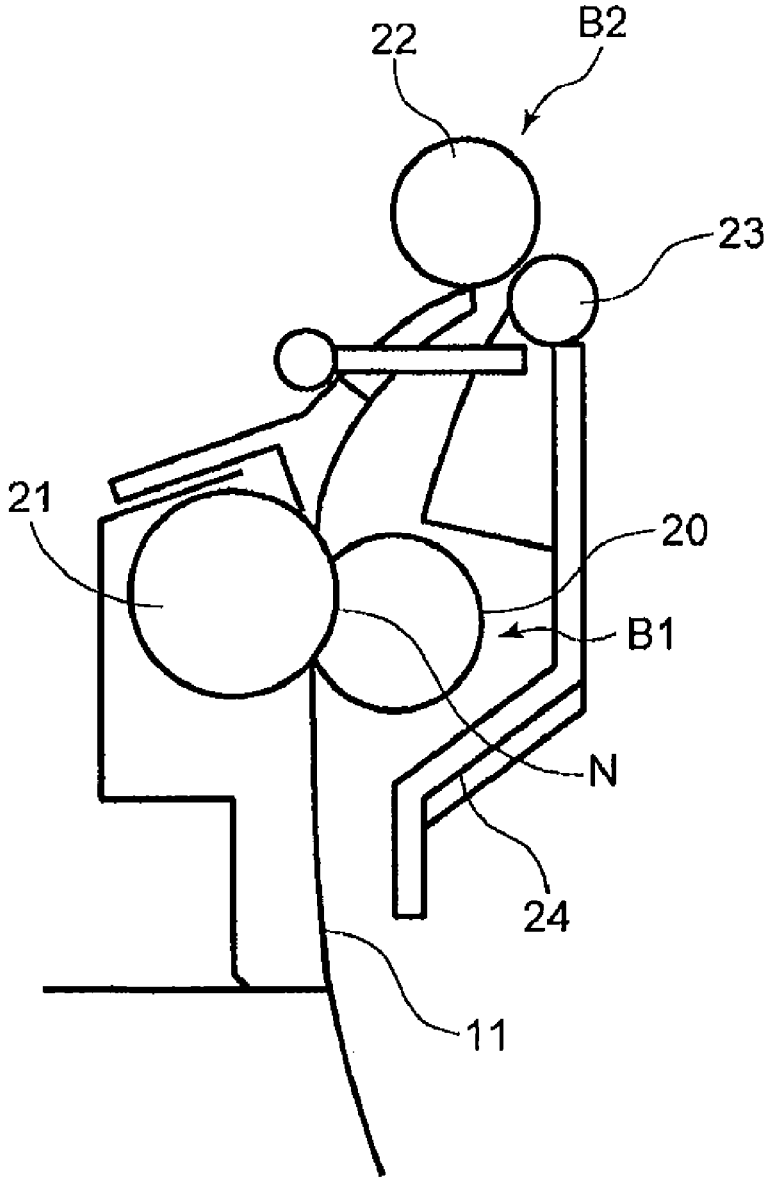
FIG. 2 is a diagram illustrating the structure of a fixing device provided in the laser beam printer.

As illustrated in FIG. 2, in the fixing device B, a pressure roller 21 comes into pressure contact with a fixing film 20 that is rotatably supported by a supporting member (not illustrated) to form a fixing portion B1. The fixing film 20 is heated by a heater (not illustrated). When the sheet passes through a nip portion N between the fixing film and the pressure roller 21, the fixing film heats and presses a non-fixed toner image formed on the sheet.

As illustrated in FIG. 2, a sheet conveying apparatus B2 that conveys the sheet having the toner image fixed thereto such that the sheet can be discharged to the discharge tray 9 is provided on the downstream side of the fixing portion B1 in a direction in which the sheet is conveyed, and the sheet conveying apparatus B2 includes a discharge roller 22 and discharge skids 23 that come into pressure contact with the discharge roller 22. The discharge roller (conveying roller) 22, which is a first rotator, is rotated by a driving source (not illustrated), and includes a discharge roller rubber 22*a* which is a rotator body made of heat resistant rubber and is provided coaxially with a roller shaft 22*d*.

The discharge skid 23 is pressed against the discharge roller rubber 22*a* by an urging unit (not illustrated), and is rotated with the rotation of the discharge roller 22. The discharge skid 23 is rotatably attached to a conveying guide 24 illustrated in FIG. 2 that guides the sheet. The sheet having the toner image fixed by the fixing portion is conveyed (discharged) by the discharge roller 22 and the discharge skid 23 while being nipped therebetween, with its toner image formed surface being contacted with the discharge skid (convey skids) 23, which is a second rotator.

Figure 3:
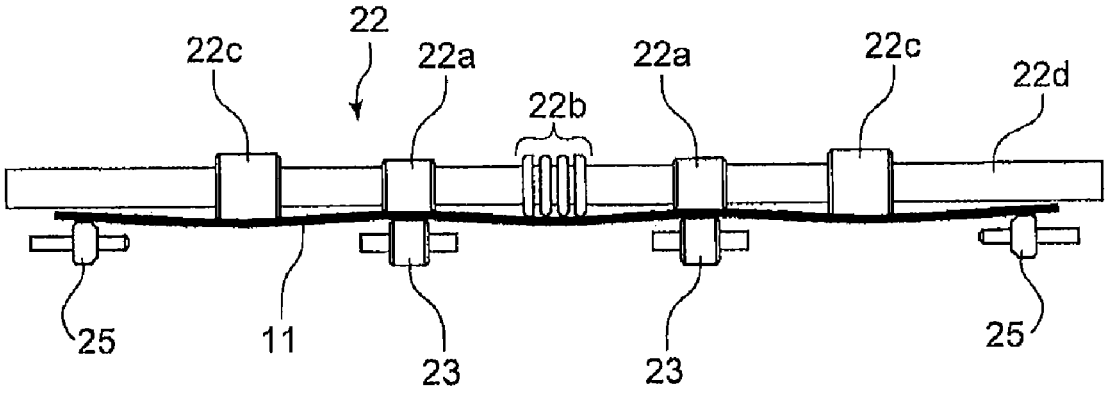
FIG. 3 is a diagram illustrating the structure of a sheet conveying apparatus provided in the fixing device.

However, as illustrated in FIG. 3, in order to stiffen the discharged sheet to prevent curling or improve stacking capacity, a central rib 22*b*, which is a stiffening member, is provided at the center of the roller shaft 22*d*, and discharge roller rings 22*c*, which are stiffening members, are provided at both sides of the central rib 22*b*. The discharge roller rubbers 22*a* are provided between the central rib 22*b* and the discharge roller rings 22*c*, In addition, discharge stiffening skids 25, which are stiffening members, come into pressure contact with both ends of the roller shaft 22*d* in the axial direction.

In this embodiment, the discharge roller central rib 22*b* is provided between the discharge roller rubbers 22*a*. In addition, the outside diameter of each of the discharge roller central rib 22*b* and the discharge roller rings 22*c* is larger than that of the discharge skid rubber 23*a*, in order to stiffen the sheet. According to this structure, when the sheet is conveyed by the discharge roller 22 and the discharge skid 23 while being nipped therebetween, the sheet is curved in a wave shape in the axial direction, as illustrated in FIG. 3. In particular, the discharged sheet has a substantially R shape in the vicinity of the discharge skid 23.

Figure 4:
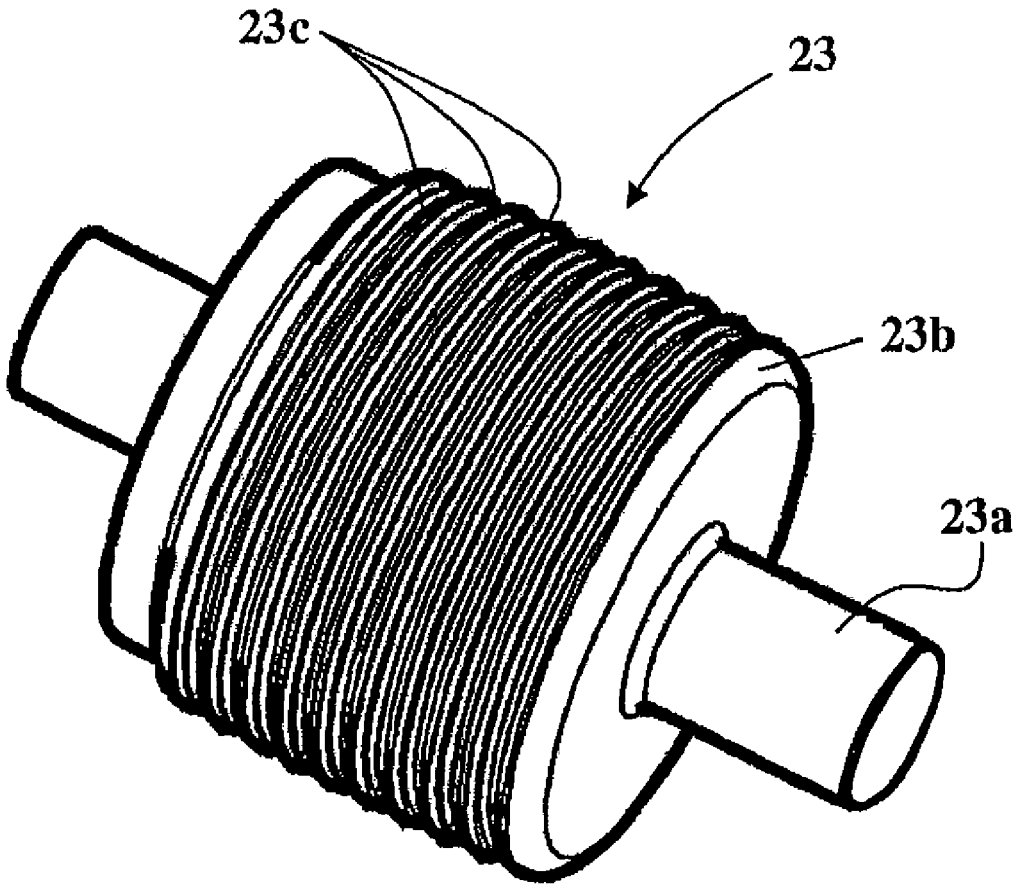
FIG. 4 is a perspective view illustrating a discharge skid of the sheet conveying apparatus.

Next, the structure of the discharge skid 23 according to this embodiment will be described. As illustrated in FIG. 4, the discharge skid 23 includes a rotating shaft 23*a* and a skid body 23*b* that is formed of, for example, engineering plastic, has a predetermined heat-resistant temperature, and is fixed to the rotating shaft 23*a*. The skid body 23*b* has a drum shape with an outside diameter that is reduced from the center to both ends in the axial direction.

In addition, a plurality of ring-shaped minute ribs 23*c* are provided on the circumferential surface of the skid body 23*b* at predetermined pitches in the axial direction so as to be continuous in the circumferential direction. The pitches between the minute ribs 23*c* will be described below.

Figure 5:
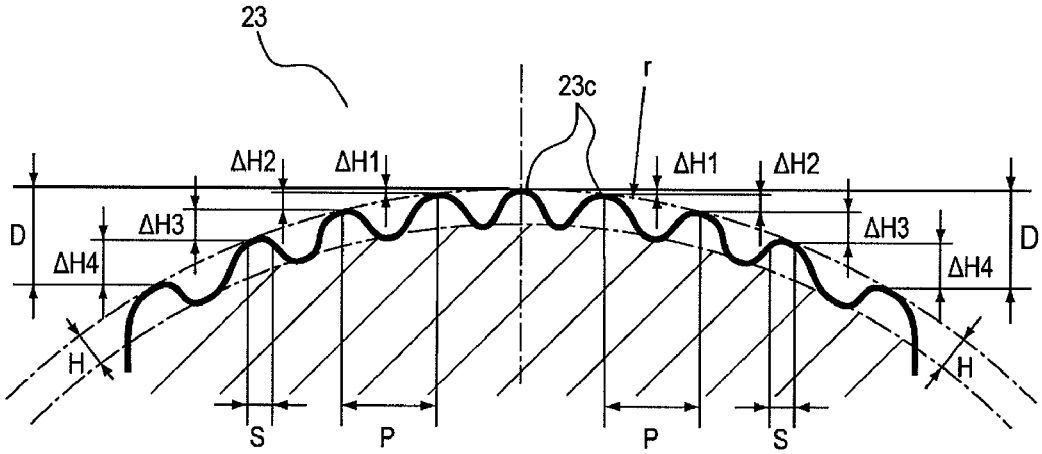
FIG. 5 is an enlarged cross-sectional view illustrating the circumferential surface of the discharge skid.

As illustrated in FIG. 5, the diameter of the minute rib 23*c* is gradually reduced from the center to both ends thereof so as to correspond to the drum-shaped skid body 23*b*. In addition, a curved line linking the tops of the minute ribs 23*c* has an R shape that is similar to the shape of the sheet when the sheet is discharged, such that the minute ribs are uniformly contacted with the sheet that has a substantially R shape in the vicinity of the discharge skid 23 when the sheet is conveyed by the discharge roller 22 and the discharge skid 23 while being nipped therebetween.

In this embodiment, the number of minute ribs 23*c* is 10, but the invention is not limited thereto. Any number of minute ribs 23*c* may be used as long as they can have a shape that is similar to the shape of the sheet when the sheet is discharged and be uniformly contacted with the sheet. Of course, the number of minute ribs may increase if the conditions are satisfied. It is preferable that the number of minute ribs 23*c* increase in order to disperse pressing force against the sheet.

In this embodiment, the outer circumferential surfaces of the minute ribs 23*c* are formed so as to be aligned with the outer circumferential surface of the skid body 23*b*. That is, in this embodiment, the circumferential surface of the skid body 23*b* is formed to have a shape corresponding to the sheet pressed by, for example, the central rib 22*b* and the discharge roller rings 22*c*, and the plurality of minute ribs 23*c* form the circumferential surface of the skid body 23*b* contacted with the sheet. The minute ribs 23*c* are formed integrally with the skid body 23*b*, and are made of POM having high slidability. The minute ribs 23*c* and the skid body 23*b* may be separately formed.

Figure 6:
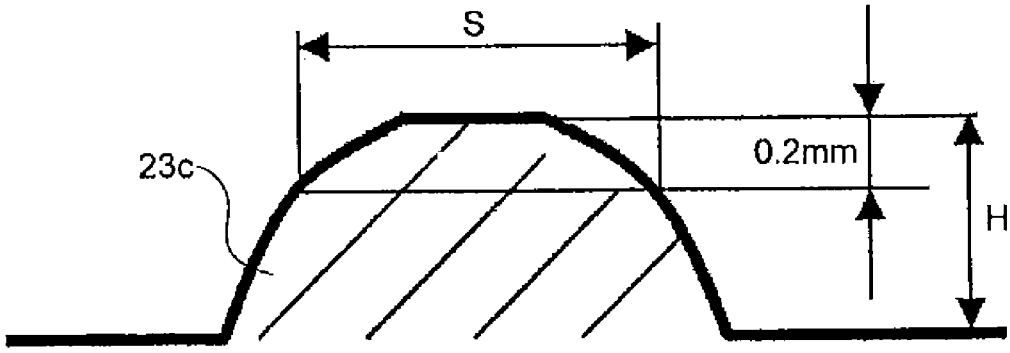
FIG. 6 is a diagram illustrating the contact width of a minute rib provided in the discharge skid with a sheet.

As illustrated in FIG. 6, the top of the minute rib 23*c* according to this embodiment is flat. However, the top of the minute rib may be curved. When the top of the minute rib is flat, the edge of the minute rib may have an R shape that is chamfered, or it may have other shapes.

Next, parameters of the minute rib 23*c* according to this embodiment will be described. As illustrated in FIG. 5, the parameters of the minute rib 23*c* include, for example, the contact width S of each minute rib 23*c* with the sheet, a pitch P between adjacent minute ribs, the height H of the minute rib 23*c* from a groove, height differences ΔH1 to ΔH4 between adjacent minute ribs 23*c*, a height difference D between the minute rib 23*c* disposed at the center of the discharge skid 23 and the minute ribs 23*c* disposed at both ends thereof, and the curvature radius r of a curved line linking the tops of the minute ribs 23*c*.

In this embodiment, as illustrated in FIG. 6, the contact width S of each minute rib 23*c* with the sheet is the distance between intersections of the curved line of the minute rib and a line that is 0.2 mm lower than the top of the minute rib 23*c* and is parallel to the axial direction. A distance of 0.2 mm is determined since the amount of bite of the minute rib 23*c* to the sheet is a maximum of about 0.2 mm.

In this embodiment, the contact width S of each minute rib 23*c* with the sheet is about 400 μm, the pitch P between adjacent minute ribs is about 700 μm, the height H of the minute rib 23*c* from the groove is about 200 μm. In addition, each of the height differences ΔH1 to ΔH4 between adjacent minute ribs 23*c* is about 20 μm, the height difference D between the minute rib 23*c* disposed at the center and the minute ribs 23*c* disposed at both ends is about 110 μm, and the curvature radius r of the curved line linking the tops of the minute ribs 23*c* is about R45 mm.

Next, the threshold values of the parameters of the minute ribs 23*c* that are experimentally calculated will be described. FIG. 7 is a diagram illustrating the evaluation of a toner image that is heated and fixed by the fixing portion and then conveyed by the discharge roller 22 and the discharge skid 23 while being nipped therebetween when the parameters of the minute ribs 23*c* are changed. The image evaluation illustrated in FIG. 7 is made by visual determination. As the result of the determination, "o" indicates that image quality does not deteriorate, and "x" indicates that image quality deteriorates. Next, the threshold values of the parameters of the minute ribs 23*c* will be described with reference to the results illustrated in FIG. 7.

First, the contact width of the minute rib 23*c* with the sheet will be described. When the contact width S is more than 600 μm, in the toner image fixed to the sheet, the width of a portion thereof whose surface property is changed by the minute ribs 23*c* is increased. As a result, it is difficult to sufficiently prevent deterioration of image quality due to a roller trace generated by the minute ribs 23*c*.

In contrast, when the contact width S of each minute rib 23*c* with the sheet is 600 μm or less, a portion of the toner image whose surface property is changed is sufficiently narrowed, and it is possible to prevent deterioration of image quality. Therefore, it is preferable that the contact width S of the minute rib 23*c* with the sheet is set to a predetermined value of 600 μm or less.

Next, the pitch between the minute ribs 23*c* will be described. When the pitch P between adjacent minute ribs 23*c* is 200 μm or less, in the toner image fixed to the sheet, the pitch between portions whose surface properties are changed by the minute ribs 23*c* is reduced. Therefore, as a result, the same state as that when flat shape without ribs is provided is obtained, and it is difficult to prevent deterioration of image quality due to a roller trace. In addition, when the pitch P between adjacent minute ribs 23*c* is 200 μm or less and the discharge skid 23 is made of a resin material, it is difficult to form the mold of the discharge skid 23. As a result, it is difficult to ensure mass product.

When the pitch P between adjacent minute ribs 23*c* is more than 1000 μm, in the toner image fixed to the sheet, the pitch between portions whose surface properties are changed by the minute ribs 23*c* is excessively large. Therefore, in the toner image, a portion whose surface property is changed and another portion whose surface property is not changed are visible.

In addition, when the pitch P between adjacent minute ribs 23*c* is more than 1000 μm and the length of a portion of the discharge skid 23 that comes into pressure contact with the discharge roller 22 in the rotating shaft direction is maintained at a predetermined value, the number of minute ribs 23*c* is reduced, and the conveying force of the sheet is lowered. In this case, when the pressure of the discharge skid 23 against the discharge roller 22 is increased in order to maintain the conveying force, it is difficult to prevent deterioration of image quality due to a roller trace or the peeling of toner.

In contrast, when the pitch P between adjacent minute ribs 23*c* is 200 μm or more and 1000 μm or less, it is not necessary to increase the conveying force of the sheet, thereby preventing deterioration of image quality. Therefore, it is preferable that the pitch P between adjacent minute ribs is set to a predetermined value in the range of 200 μm or more and 1000 μm or less.

Next, the height of the minute rib 23*c* from the groove will be described. When the height H of the minute rib 23*c* from the groove is less than 100 μm, a concave portion of the minute rib 23*c* is close to the sheet, and the concave portion dissipates the heat of the toner image fixed to the sheet. As a result, a roller trace is generated, and image quality deteriorates.

On the other hand, when the height H of the minute rib from the groove is more than 300 μm, it is difficult to form the mold of the discharge skid 23 which is made of a resin material and in which the pitch between adjacent minute ribs is maintained in the above predetermined range. Therefore, it is difficult to ensure the mass product of the discharge skid 23. For this reason, it is preferable that the height of the minute rib 23*c* from the groove is set to a predetermined value in the range of 100 μm or more and 300 μm or less.

Next, the height difference between adjacent minute ribs 23*c* will be described. When the height differences ΔH1 to ΔH4 between adjacent minute ribs 23*c* are less than 0 μm, that is, when the height relationship is reversed such that the height H of the minute rib 23*c* from the groove is reduced from the center of the discharge skid 23 to both ends thereof, some of the minute ribs 23*c* do not contact the sheet. Therefore, the minute ribs 23*c* that contact the sheet locally apply high pressure to the sheet, and image quality deteriorates due to the peeling of toner or an uneven portion of the sheet.

On the other hand, when the height differences ΔH1 to ΔH4 between adjacent minute ribs 23*c* are more than 60 μm, there is a large variation in the height H of each minute rib 23*c*, and some of the minute ribs 23*c* do not contact the sheet. Therefore, similar to when the height differences ΔH1 to ΔH4 between adjacent minute ribs 23*c* are less than 0 μm, image quality deteriorates due to the peeling of toner or an uneven portion of the sheet. For this reason, it is preferable that the height differences ΔH1 to ΔH4 between adjacent minute ribs 23*c* is set to a predetermined value in the range of 0 μm or more and 60 μm or less.

Next, the height difference between the minute rib disposed at the center of the discharge skid 23 and the minute ribs disposed at both ends thereof will be described. If the height difference D between the minute rib disposed at the center of the discharge skid 23 and the minute ribs disposed at both ends thereof is less than 20 μm, the minute ribs disposed at both ends of the discharge skid 23 are strongly contacted with the sheet when the sheet or the discharge skid 23 is inclined. Therefore, the peeling of toner occurs, or an uneven portion is formed on the sheet by the minute ribs disposed at both ends of the discharge skid 23. The uneven portion of the sheet causes image quality to deteriorate.

If the height difference D between the minute rib disposed at the center of the discharge skid 23 and the minute ribs disposed at both ends thereof is more than 210 μm, the curvature radius of a curved line linking the tops of the minute ribs 23*c* is reduced, and the minute rib disposed at the center of the discharge skid 23 is strongly contacted with the sheet. Therefore, an uneven portion having the same shape as the curved line linking the tops of the minute ribs 23*c* is formed on the sheet, which causes image quality to deteriorate. For this reason, it is preferable that the height difference D between the minute rib disposed at the center of the discharge skid 23 and the minute ribs disposed at both ends thereof is set to a predetermined value in the range of 20 μm or more and 210 μm or less.

Next, the correlation between the parameters of the minute ribs 23*c* will be described.

First, the contact width S of each minute rib 23*c* with the sheet is not correlated to the other parameters. This is because the width of a portion of the toner image whose surface property is changed depends on only the contact width S of the minute rib 23*c* with the sheet.

In addition, the height H of the minute rib 23*c* from the groove is not correlated to the other parameters. This is because the degree of dissipation of heat from the toner image fixed to the sheet by a concave portion of the minute rib 23*c* depends on only the height H of the minute rib 23*c* from the groove. When the height H of the minute rib from the groove is more than 300 μm, it is difficult to form the mold of the discharge skid 23 which is made of a resin material and in which the pitch P between adjacent minute ribs is maintained in the above-mentioned predetermined range without depending on parameters other than the height H.

The pitch P between adjacent minute ribs, the height differences ΔH1 to ΔH4 between adjacent minute ribs 23*c*, and the height difference D between the minute rib disposed at the center of the discharge skid 23 and the minute ribs disposed at both ends thereof are correlated to the evaluation of image quality. FIG. 8 is a diagram illustrating the evaluation of image quality when the pitches P between adjacent minute ribs 23*c* are 200 μm, 700 μm, and 1000 μm and the height differences ΔH1 to ΔH4 between adjacent minute ribs 23*c*, and the height difference D between the minute rib disposed at the center of the discharge skid 23 and the minute ribs disposed at both ends thereof are changed. The evaluation of image quality illustrated in FIG. 8 is visually determined. In FIG. 8, "<o>" indicates the highest image quality, "o" indicates that image quality does not deteriorate, and "x" indicates that image quality deteriorates.

As can be seen from the results illustrated in FIG. 8, when the pitch P between adjacent minute ribs is 200 μm and the height difference D between the minute rib disposed at the center of the discharge skid 23 and the minute ribs disposed at both ends thereof is 210 μm or more, image quality deteriorates.

The reason is that, when the pitch between adjacent minute ribs is small, the height difference between the minute rib disposed at the center of the discharge skid and the minute ribs disposed at both sides thereof is slightly increased and the curvature radius of the curved line linking the tops of the minute ribs is excessively small. When the curvature radius of the curved line is excessively small, an uneven portion having the same shape as the curved line linking the tops of the minute ribs is formed, which causes deteriorate of image quality.

When the pitch P between adjacent minute ribs is 1000 μm and the height difference D between the minute rib disposed at the center of the discharge skid and the minute ribs disposed at both ends thereof is less than 110 μm, image quality deteriorates. The reason is that, when the pitch between adjacent minute ribs is large and the height difference between the minute rib disposed at the center of the discharge skid 23 and the minute ribs disposed at both ends thereof is small, the minute ribs disposed at both ends of the discharge skid are strongly contacted with the sheet. In addition, when the pitch P between adjacent minute ribs is 1000 μm and the height differences ΔH1 to ΔH4 between adjacent minute ribs 23*c* are less than 20 μm, it is difficult to increase the height difference between the minute rib disposed at the center of the discharge skid 23 and the minute ribs disposed at both ends thereof. As a result, image quality deteriorates.

When the height differences ΔH1 to ΔH4 between adjacent minute ribs 23*c* are less than 20 μm and the height difference D between the minute rib disposed at the center of the discharge skid and the minute ribs disposed at both ends thereof is 210 μm or more, it is difficult to increase the height difference between the minute rib disposed at the center of the discharge skid and the minute ribs disposed at both ends thereof, regardless of the pitch P between adjacent minute ribs. As a result, image quality deteriorates.

On the other hand, when the pitch P between adjacent minute ribs is 700 μm, it is possible to adopt the parameters of the minute ribs in the wide range, which is most preferable. In particular, it is most preferable that the pitch P between adjacent minute ribs is about 700 μm, the height difference D between the minute rib disposed at the center of the discharge skid and the minute ribs disposed at both ends thereof is about 110 μm, and the height differences ΔH1 to ΔH4 between adjacent minute ribs is about 20 μm.

As described above, in this embodiment, when the sheet is stiffened and when the sheet is pressed and curved by, for example, the central rib 22*b* and the discharge roller rings 22*c*, the sheet has the curved shape illustrated in FIG. 3 at the nip portion between the discharge roller 22 and the discharge skid 23. Therefore, the discharge skid 23 is formed in a shape corresponding to the curved shape of the sheet such that the diameter of the discharge skid 23 is reduced from the center to both ends in the axial direction, and a plurality of minute ribs 23*c* are formed on the circumferential surface of the discharge skid 23 in the axial direction so as to be continuous in the circumferential direction. As such, when the sheet is stiffened, it is preferable that the curved shape of the sheet (bent shape) caused by stiffness corresponds to the shape of the discharge skid 23.

That is, in this embodiment, the discharge skid 23 is formed such that the diameter thereof is reduced from the center to both ends in the axial direction, and a plurality of minute ribs 23*c* are formed on the circumferential surface of the discharge skid 23 in the axial direction so as to be continuous in the circumferential direction. In this way, the minute rids 23*c* come into linear contact with the sheet to discharge it while maintaining conveying force required for the sheet. Therefore, it is possible to minimize the amount of heat dissipated from the sheet by the discharge skid 23.

In this embodiment, a case in which the sheet is stiffened by the central rib 22*b* or the discharge roller rings 22*c* is given as an example. However, even when the sheet is not stiffened, the discharge skid 23 that comes into contact with a surface of the sheet having an image formed thereon may have the above-mentioned shape. In this case, it is also possible to prevent deterioration of image quality.

Furthermore, since the minute rib 23*c* does not have an uneven portion in the direction in which the sheet is discharged, in the toner image fixed to the sheet, a portion whose surface property is changed due to contact can be prevented from being visually viewed, without damaging a toner parting property. In addition, since the discharge skid 23 is formed such that the diameter thereof is reduced from the center to both ends in the axial direction, it is possible to prevent high pressure from being locally generated while reducing a contact area. As a result, it is possible to prevent the generation of a roller trace, the peeling of an image, and the generation of an uneven portion on a sheet with a low cost, as compared to the related art.

Furthermore, a plurality of minute ribs 23*c* are formed on the circumferential surface of the discharge skid 23 in the axial direction so as to be continuous in the circumferential direction, thereby reliably discharging a sheet with a low cost without deteriorating image quality.

Next, a second embodiment of the invention will be described.

Figure 9:
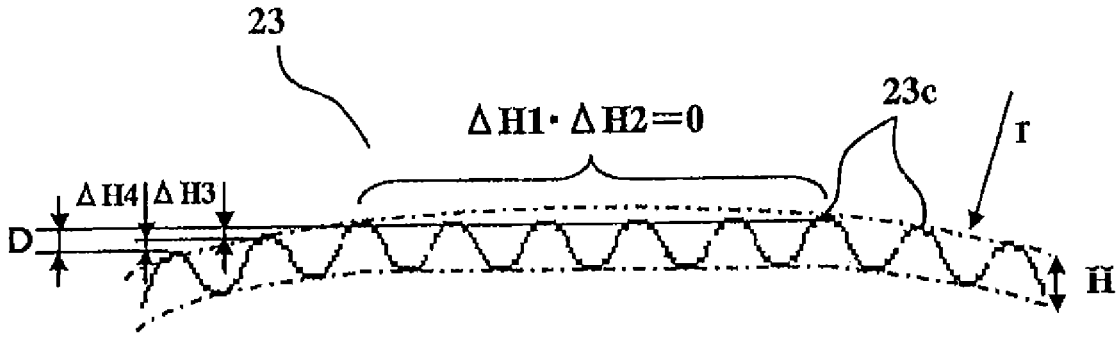
FIG. 9 is a diagram illustrating a discharge skid provided in a sheet conveying apparatus according to a second embodiment of the invention.
Figure 10A:
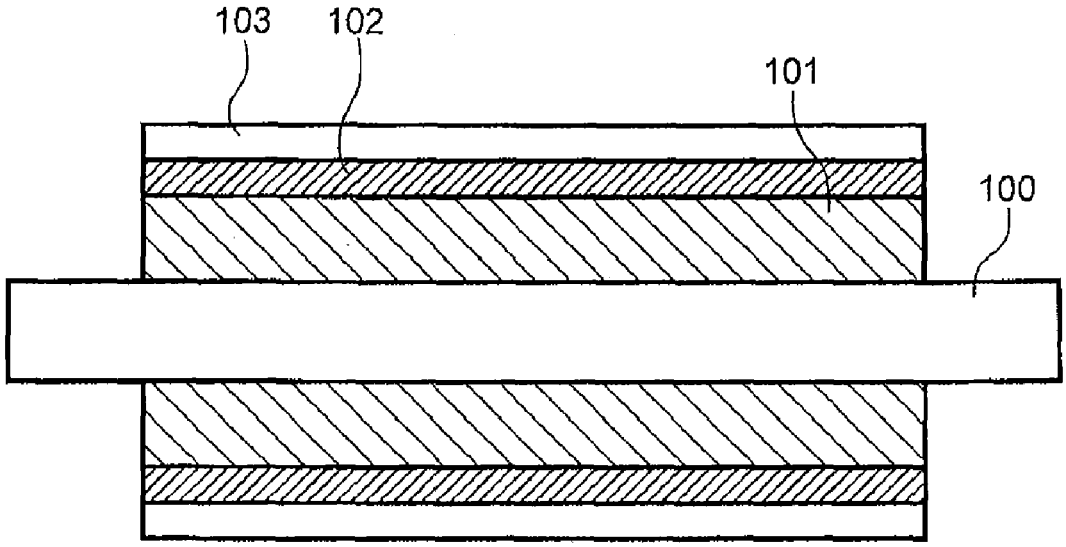
FIG. 10A PRIOR ART
FIGS. 10A and 10B are diagrams illustrating the structure of a sheet conveying apparatus according to the related art.
Figure 10B:
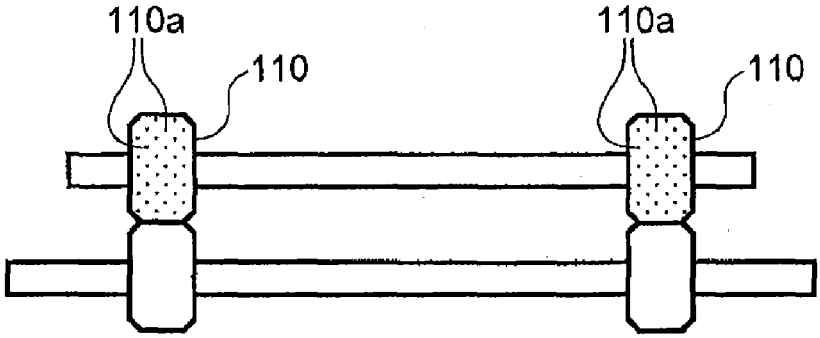
FIG. 10B PRIOR ART

FIG. 9 is a diagram illustrating a discharge skid provided in a sheet conveying apparatus according to the second embodiment. In FIG. 9, the same components or equivalents as those illustrated in FIG. 5 are denoted by the same reference numerals.

In this embodiment, as illustrated in FIG. 9, 10 minute ribs 23*c* are provided. Six minute ribs 23*c* disposed at the center of the discharge skid 23 have the same outside diameter, and the outside diameters of four minute ribs 23*c* disposed at both ends of the discharge skid in the axial direction are gradually reduced toward both ends.

In the above-mentioned structure, the height differences ΔH1 and ΔH2 between adjacent minute ribs 23*c* disposed at the center of the discharge skid 23 is approximately 0 μm. It is preferable that the height differences ΔH1 and ΔH2 is 20 μm or less in order to prevent deterioration of image quality. When the height differences ΔH1 and ΔH2 are 20 μm or less, it is possible to contact all the minute ribs 23*c* with the sheet, and it is possible to prevent high pressure from being locally applied to the sheet.

The relationship between the height differences ΔH1 and ΔH2 and the evaluation of image quality is the same as that in the first embodiment. In addition, the relationship between the evaluation of image quality and the parameters of the minute ribs 23*c*, such as the contact width S of the minute rib 23*c* with the sheet, the pitch P between adjacent minute ribs, the height H of the minute rib 23*c* from the groove, and the height difference D between the minute rib disposed at the center of the discharge skid 23 and the minute ribs disposed at both ends thereof, is the same as that in the first embodiment.

As described above, six minute ribs disposed at the center of the discharge skid 23 have the same outside diameter, thereby reliably ensuring pressing force against the sheet 11 at the center of the discharge skid 23. In addition, since four minute ribs 23*c* are formed at both ends of the discharge skid 23 in the axial direction such that their outside diameters are reduced toward both ends of the discharge skid in the axial direction, the shape of the minute ribs 23*c* corresponding to the shape of the discharged sheet can be obtained, similar to the first embodiment.

In this way, conveying force required to convey the sheet 11 can be obtained. In addition, in the toner image fixed to the sheet 11, it is possible to prevent a portion of the toner image whose surface property is changed due to contact with the discharge skid 23 from being visually viewed.

In the above-described embodiments, a full-color laser beam printer is given as an example of the image forming apparatus, but the invention is not limited thereto. For example, the invention may be applied to a monochrome printer and image forming apparatuses other than the printers, such as a copying machine and a facsimile. In addition, in the above-described embodiments, the minute ribs are formed on the discharge skid 23, but the invention is not limited thereto. The minute ribs 23*c* may be formed on at least one of the discharge skid 23 and the discharge roller rubber 22*a*. In the above-described embodiments, the minute rib 23*c* has a ring shape, but the minute rib 23*c* may have a screw shape.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-092675, filed Mar. 31, 2008, which is hereby incorporated by reference herein in its entirety.

What is claimed is:

1. An image forming apparatus, comprising:

an image forming portion that forms an image on a sheet;

a fixing portion that thermally fixes a toner image formed by the image forming portion to the sheet;

a first roller;

a second roller that comes into pressure contact with the first roller and contacts a surface of the sheet having the image fixed thereon by the fixing portion, wherein an outer circumference surface of the first roller and an outer circumference surface of the second roller nip the sheet and convey the sheet;

and a plurality of ribs that are formed on the outer circumference surface of the second roller and disposed so that each rib extends in a circumferential direction, the plurality of ribs arranged in an axial direction of the second roller, wherein, among the plurality of ribs, ribs disposed at both ends of the second roller in the axial direction have a diameter that is smaller than the remaining ribs of the plurality of ribs.

2. An image forming apparatus according to claim 1, wherein, among two arbitrary adjacent ribs of the plurality of ribs, one of the two arbitrary adjacent ribs closer to a center in the axial direction has a diameter that is larger than that of the other rib of the two arbitrary adjacent ribs further from the center in the axial direction.

3. An image forming apparatus according to claim 1, wherein contact width of each of the plurality of ribs with the sheet is 600 μm or less, and a pitch between adjacent ribs is at least 200 μm and no more than 1000 μm.

4. An image forming apparatus according to claim 3, wherein a height of each of the plurality of ribs is at least 100 μm and no more than 300 μm.

5. An image forming apparatus according to claim 3, wherein a height of each of the plurality of ribs is at least 100 μm and no more than 300 μm, a height difference between adjacent ribs is at least 0 μm and no more than 60 μm, and a height difference between a rib disposed at a center of the second roller and ribs disposed at both ends thereof in the axial direction is at least 20 μm and no more than 210 μm.

6. An image forming apparatus according to claim 1, wherein the first roller includes:

a plurality of roller bodies; and stiffening members that are provided between the plurality of roller bodies and press the sheet which is conveyed by the plurality of roller bodies and the second roller while being nipped there between to stiffen the sheet, wherein the second roller is formed such that a diameter thereof is reduced from a center to both ends in the axial direction, and a shape of the second roller corresponds to a shape of the sheet that is pressed and curved by the stiffening members, and a contact surface of the outer circumference surface of the second roller with the sheet includes the plurality of ribs.

7. An image forming apparatus for conveying a sheet having an image formed thereon, comprising:

an image forming portion that forms an image on a sheet;

a fixing portion that thermally fixes a toner image formed by the image forming portion to the sheet;

a first roller;

a second roller that comes into pressure contact with the first roller and contacts a surface of the sheet having the image fixed thereon by the fixing portion, wherein an outer circumference surface of the first roller and an outer circumference surface of the second roller nip the sheet and convey the sheet;

and a plurality of ribs that are formed on the outer circumference surface of the second roller and disposed so that each rib extends in a circumferential direction, the plurality of ribs arranged in an axial direction of the second roller, wherein, among two arbitrary adjacent ribs of the plurality of ribs, one of the two arbitrary adjacent ribs closer to a center in the axial direction has a diameter that is the same as that of the other rib further from the center in the axial direction or larger than that of the other rib further from the center in the axial direction, a height difference between the two adjacent ribs is at least 0 μm and no more than 60 μm, and a height difference between a rib disposed at the center of the second roller and ribs disposed at both ends thereof in the axial direction is at least 20 μm and no more than 210 μm.

8. An image forming apparatus according to claim 7, wherein, among two arbitrary ribs of the plurality of ribs, one of the two arbitrary adjacent ribs closer to the center in the axial direction has a diameter that is larger than that of the other rib further from the center in the axial direction.

9. An image forming apparatus according to claim 7, wherein a contact width of each of the plurality of ribs with the sheet is 600 μm or less, and a pitch between adjacent ribs is at least 200 μm and no more than 1000 μm.

10. An image forming apparatus according to claim 9, wherein a height of each of the plurality of ribs is at least 100 μm and no more than 300 μm.

11. An image forming apparatus according to claim 7, wherein the first roller includes:

a plurality of roller bodies; and stiffening members that are provided between the plurality of roller bodies and press the sheet which is conveyed by the plurality of roller bodies and the second roller while being nipped there between to stiffen the sheet, wherein the second roller is formed such that the diameter thereof is reduced from the center to both ends in the axial direction, and a shape of the second roller corresponds to a shape of the sheet that is pressed and curved by the stiffening members, and a contact surface of the outer circumference surface of the second roller with the sheet includes the plurality of ribs.

12. An image forming apparatus comprising:

an image forming portion that forms an image on a sheet;

a fixing portion that thermally fixes a toner image formed by the image forming portion to the sheet;

a first roller;

a second roller that comes into pressure contact with the first roller and contacts a surface of the sheet having the image fixed thereon by the fixing portion, wherein an outer circumference surface of the first roller and an outer circumference surface of the second roller nip the sheet and convey the sheet; and a plurality of ribs that are formed on the outer circumference surface of the second roller and disposed so that each rib extends in a circumferential direction, the plurality of ribs arranged in an axial direction of the second roller, wherein a virtual line linking tops of the plurality of ribs is curved in a direction that a center of the line in the axial direction is further away from an axis of rotation of the second roller than each end of the virtual line.

* * * * *